US006315290B1

(12) United States Patent
Roethel et al.

(10) Patent No.: US 6,315,290 B1
(45) Date of Patent: Nov. 13, 2001

(54) EXTRA BALL KENO GAME

(76) Inventors: John Edward Roethel, 4880 W. University Ave., Suite B-3, Las Vegas, NV (US) 89103; Michael W. Wood, 11831 Wentling Ave., Suite #C, Baton Rouge, LA (US) 70816

( * ) Notice: Subject to any disclaimer, the term of this patent is extended or adjusted under 35 U.S.C. 154(b) by 0 days.

(21) Appl. No.: 09/549,955

(22) Filed: Apr. 14, 2000

(51) Int. Cl.[7] ..... A63B 71/00

(52) U.S. Cl. ..... 273/138.1; 273/292; 273/273; 273/274

(58) Field of Search ..... 273/292, 273, 273/274, 269, 138.1, 139; 463/13, 12, 18

(56) References Cited

U.S. PATENT DOCUMENTS 5,651,735 * 7/1997 Baba ..... 463/18
5,882,259 * 3/1999 Holmes ..... 463/13

* cited by examiner

*Primary Examiner*—Jeanette Chapman
*Assistant Examiner*—D Collins
(74) *Attorney, Agent, or Firm*—John Edward Roethel

(57) ABSTRACT

A keno game method includes initially randomly selecting a predetermined number of keno numbers after the player has selected two or more keno numbered spots that the player hopes to match. For each numbered spot matched or "Hit" by the player during the base game, an additional keno number is randomly selected during the extra ball portion of the game. In one version, the quantity of additional keno numbers to be drawn is determined by the amount of "Hits" during only the initial draw of keno numbers. In another version, the quantity of additional keno numbers to be drawn is cumulative from the "Hits" achieved over both the initial draw of keno numbers and during any additional draws. An award is made to the player for the total number of "Hits" achieved during the round of the game and based on the amount wagered by the player. In another version, an award is made to the player for the total number of "Misses" achieved during the extra ball portion of the game and based on the amount wagered by the player.

29 Claims, 3 Drawing Sheets

EXTRA BALL KENO GAME

This invention relates primarily to a live or electronic video keno game, and more particularly to a live or electronic video keno game in which the player receives an extra draw of a keno number from the keno number pool for each "Hit" that the player achieves during the play of the keno game.

BACKGROUND OF THE INVENTION

Keno is a well known game and has been played in gaming establishments for many years. In conventional keno, there are eighty numbers in the pool of numbers that may be drawn in any one round of the game. In the typical keno game, eighty keno balls are numbered 1 through 80 and are placed in a air blower device that circulates the keno balls. Twenty of the eighty keno balls are selected each game.

Each player marks a keno ticket that is an 10×8 matrix having ten columns and eight rows. The keno numbers from one through eighty are printed on the keno ticket with each keno number having its own numbered spot. Prior to the start of a round of the keno game, a player selects between one and fifteen numbered spots that the player thinks will be drawn during the game. Typically a player uses a crayon-like pencil to mark the numbered spots he wishes to play on his keno ticket and the player takes his marked keno ticket to a keno station. The player makes an appropriate wager and turns in his marked keno ticket and the money at the keno station. The player receives back a stamped and receipted ticket showing the amount of the player's wager and the numbered spots that the player has selected.

The keno game operator then proceeds to draw twenty keno numbers from the eighty keno balls. Depending on the number of matches or "Hits" between the twenty keno numbers drawn and the numbered spots selected by the player, the player wins or loses. The more keno numbers that match the player's numbered spots, the higher the payoff to the player.

In a live keno game, multiple players participate in each game and no players may win, some players may win or all players may win. In traditional live keno, players may select between one and fifteen numbered spots and wagers can range from as little as 35¢ a game to $5, $10 or even higher dollars per game. Typically each establishment operating a keno game will provide a group of keno pay tables showing the amount that it is possible for the player to win based on the amount wagered, the amount of numbered spots selected by the player and the number of matches or "Hits" achieved by the player when the twenty keno balls are selected.

For example, if the player wagers $1 and selects one numbered spot, the player will typically win $3 if his selected numbered spot is one of the twenty numbered keno balls drawn during the play of the game. Similarly, if the player selects fifteen numbered spots, the player will typically be paid if anywhere between a total of eight and fifteen of his numbered spots match the twenty numbered keno balls drawn. The highest payout will be made for matching fifteen out of fifteen, with lower payouts made for matching fourteen out of fifteen, thirteen out of fifteen and so on down to eight out of fifteen. Any matches of seven or less numbered spots are typically losing plays. Similar payout schemes are provided when the player marks between one and fifteen numbered spots during any round of a keno game.

When the player plays an electronic video keno gaming machine, a single player plays against the keno gaming machine for each round of the game and the player either wins or loses each round. The player wagers a coin, token or credit and selects the quantity of numbered spots that the player is attempting to match or "Hit" during that round of the game. All eighty numbers are displayed on a video screen with a 10×8 matrix similar to that of a keno ticket. The numbered spots are selected by the player using a light pen, or by pressing the numbered spots on a selection panel or by touching the numbered spots selected using conventional touch screen technology.

In the typical electronic keno format, the player may select between one and ten numbered spots to attempt to match. After the player has completed selecting the numbered spots that the player wishes to match and has made the appropriate wager, the player presses the "Start" button. This causes the electronic controls of the gaming machine to randomly select twenty keno numbers from the pool of eighty keno numbers and the selected keno numbers are displayed to the player. The electronic controls of the gaming machine determine whether the player has achieved a winning payout at the conclusion of each round of the game. Just as in live keno, the player wins when he matches or "Hits" all or a predetermined minimum number of his selected numbered spots. If the player matches less than the predetermined minimum number of his selected numbered spots, then the player loses his wager. Payouts are made by accruing credits on the credit meter of the gaming machine or dispensing coins or tokens into a payout tray.

The basic principles of the play of keno are set out in Scarne's New Complete Guide to Gambling, by John Scarne, at pages 490–499.

The drawback of traditional keno is that the amount of selected keno numbers is always a fixed amount, usually twenty numbers.

It is an object of the present invention to provide an improved keno game that offers the player the opportunity to improve his chances of winning by increasing the amount of keno numbers drawn based on the number of "Hits" achieved by the player during the play of the game.

It is a feature of the present invention that a player selects two or more numbered spots on a keno display. A predetermined amount of keno numbers are drawn from a keno number pool during the base game. For each numbered spot on the keno display that is matched by a keno number drawn from the keno number pool during the base game, an additional keno number is drawn from the keno number pool during the extra draw portion of the game. Suitable keno pay tables are provided based on the number of "Hits" achieved by the player for the number of keno numbers drawn.

It is an advantage of the present invention that a game of keno will be improved by providing the player with additional opportunities to win because additional keno numbers will be drawn for each "Hit" achieved by the player.

Other objects, features and advantages of the present invention will become apparent from a consideration of the following detailed description.

SUMMARY OF THE INVENTION

A keno game method includes initially randomly selecting a predetermined number of keno numbers after the player has selected two or more keno numbered spots that the player hopes to match. For each numbered spot matched or "Hit" by the player during the base game, an additional keno number is randomly selected during the extra ball portion of the game. In one version of the present invention, the quantity of additional keno numbers to be drawn is determined by the amount of "Hits" during only the initial draw of keno numbers. In another version of the present invention, the quantity of additional keno numbers to be drawn is cumulative from the "Hits" achieved over both the initial draw of keno numbers and during any additional draws. An award is made to the player for the total number of "Hits" achieved during the round of the game and based on the amount wagered by the player.

DETAILED DESCRIPTION OF THE PREFERRED EMBODIMENTS

The method of the present invention is played using either a live keno game format or using an electronic keno gaming machine. The description that follows refers to an electronic keno gaming machine, but the same principles of the present invention can be easily adapted to a live keno game format.

Figure 1:
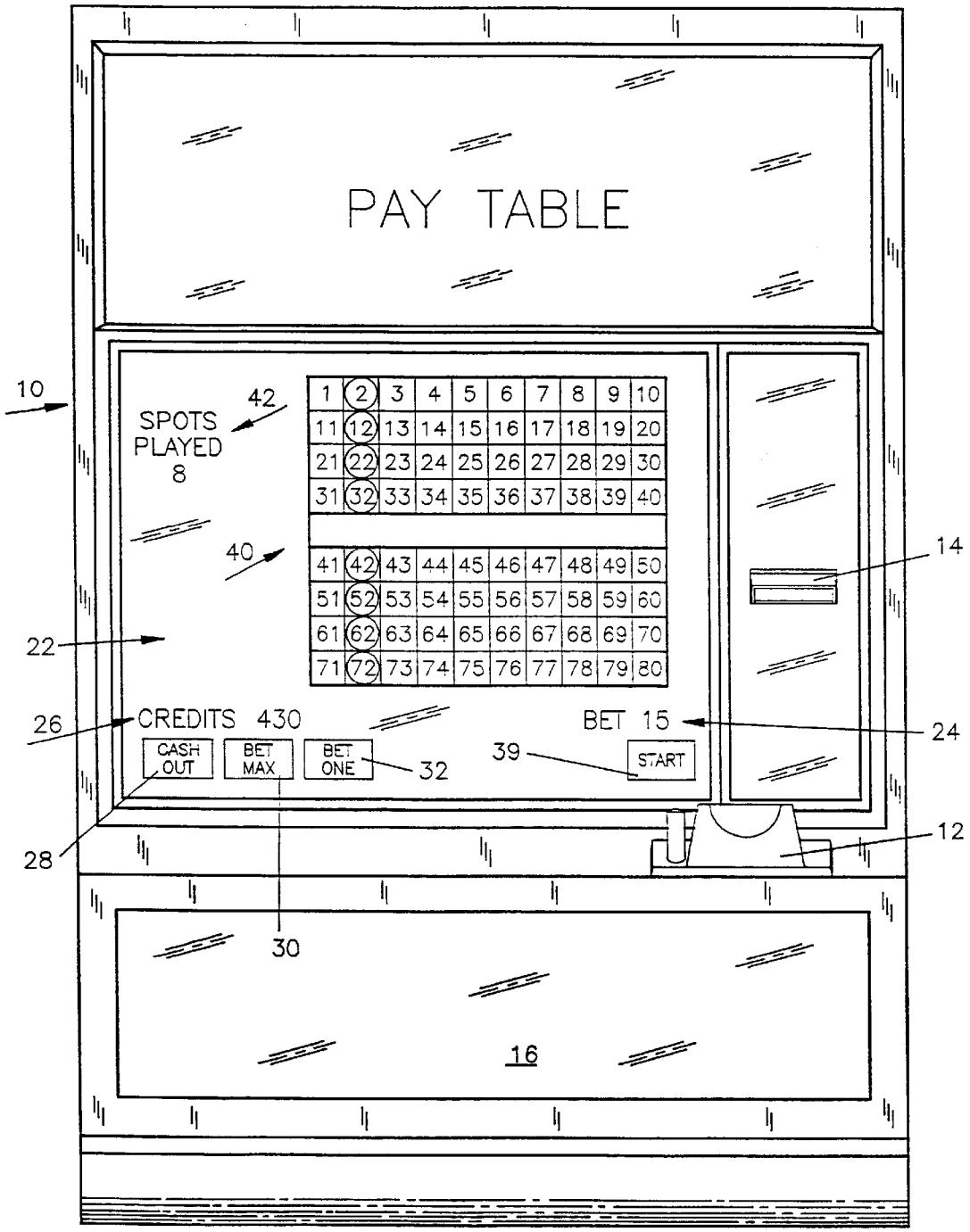
FIG. 1 shows a keno gaming machine including a representative keno ticket display that can be used in the method of the present invention with the amount of numbered spots that have been marked by the player.

An electronic keno gaming machine is shown at 10 in FIG. 1 and is provided with a video screen display 22, a coin head 12 for receiving coins or gaming tokens, a bill acceptor 14 for receiving paper currency, a coin hopper (not shown, but mounted on the interior of the gaming machine 10) for making payouts into a payout tray 16, a pay table 60 which can be displayed on the gaming glass or alternatively on the video screen display 22 and computer controls (also not shown and mounted on the interior of the gaming machine) to operate the gaming machine. Instead of using a payout hopper to dispense coins or gaming tokens when the player cashes out, a ticket printer or another suitable payout device such as a coupon device or the like may be used.

Also provided on the video screen display 22 are various touch screen locations that allow the player to make wagers, start the play of the game and collect winnings. The touch screen locations include a CASH OUT location 28, a BET MAX location 30, a BET ONE location 32 and a START location 39. Instead of using touch screen locations for the operations of the gaming machine, buttons may be provided on a button panel to allow the player to wager, start the play of the game and cash out any accumulated credits. Also provided on the video screen display 22 are locations that show the amount of the BET 24 made by the player for that round of the game and the CREDITS 26 that have been accumulated by the player during play of the game or from introducing currency into the bill acceptor 14.

Also included on the video screen display 22 is a 10×8 matrix of the eighty numbers which represents the keno ticket display 40 used in the method of play of the present invention. As the keno numbers are randomly selected during the player of the game, the selected numbers are highlighted on the matrix 40 to show the results of the play. A screen location 42 also indicates the quantity of numbered spots selected by the player for that round of the game.

FIG. 1 shows an example of an initial keno ticket display 40 with the numbered spots selected by the player being indicated by highlighting. In this example, the player has marked an EIGHT SPOT ticket with the numbered spots being 2, 12, 22, 32, 42, 52, 62 and 72.

Figure 2:
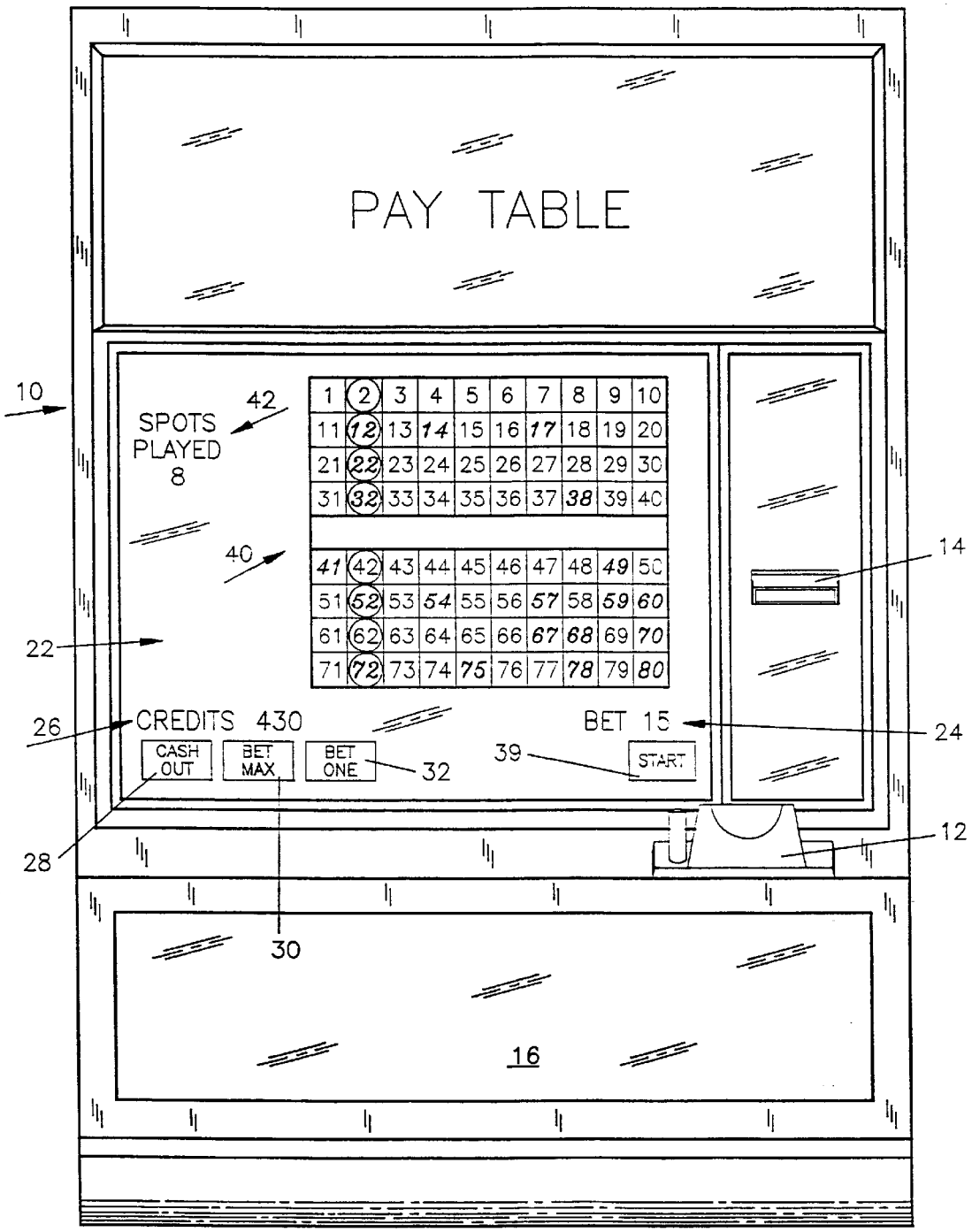
FIG. 2 shows the keno ticket after the initial draw of the regular twenty keno numbers.

After the player has made his wager, the player presses the "START" location 39 on the electronic keno gaming machine to activate the play of the game. The computer controls randomly select twenty keno numbers from the complete pool of eighty keno numbers and these twenty keno numbers are shown on the keno ticket display. For example as shown in FIG. 2, the twenty keno numbers randomly selected can be 12, 14, 17, 22, 32, 38, 41, 49, 52, 54, 57, 59, 60, 67, 68, 70, 72, 75, 78 and 80. The keno numbers selected can be indicated in any suitable manner such as the using the bold marking shown in FIG. 2 or by highlighting the selected keno numbers.

Based on the eight numbered spots selected by the player and the twenty keno numbers randomly chosen by the computer controls, the player has achieved five "Hits". The numbered spots hit by the player are 12, 22, 32, 52 and 72. The player has won an award based on the amount of the player's wager and the award is shown in a pay table for an Eight Spot ticket. A representative pay table is shown in Table 1 and the player would win five credits for each unit wagered by the player for achieving five out of eight "Hits" in the base game.

TABLE 1

EIGHT SPOT PAY TABLE
OVERALL GAME RETURN 91.86%

| | Base | EXTRA HITS | | | | |
|---|---|---|---|---|---|---|
| Base Hits | Game Pay | 0 | 1 | 2 | 3 | 4 |
| 0 | 0 | — | — | — | — | — |
| 1 | 0 | 0 | 1 | — | — | — |
| 2 | 0 | 0 | 1 | 2 | — | — |
| 3 | 0 | 0 | 1 | 4 | 200 | — |
| 4 | 1 | 0 | 2 | 8 | 599 | 3999 |
| 5 | 5 | 0 | 5 | 65 | 3195 | — |
| 6 | 70 | 0 | 30 | 3130 | — | — |
| 7 | 750 | 0 | 2250 | — | — | |
| 8 | 10000 | 0 | — | — | — | — |

Overall return on this pay table for an Eight Spot is 91.86%. Other suitable pay tables can be utilized if the gaming establishment wishes to offer a higher or lower game return to the player.

Figure 3:
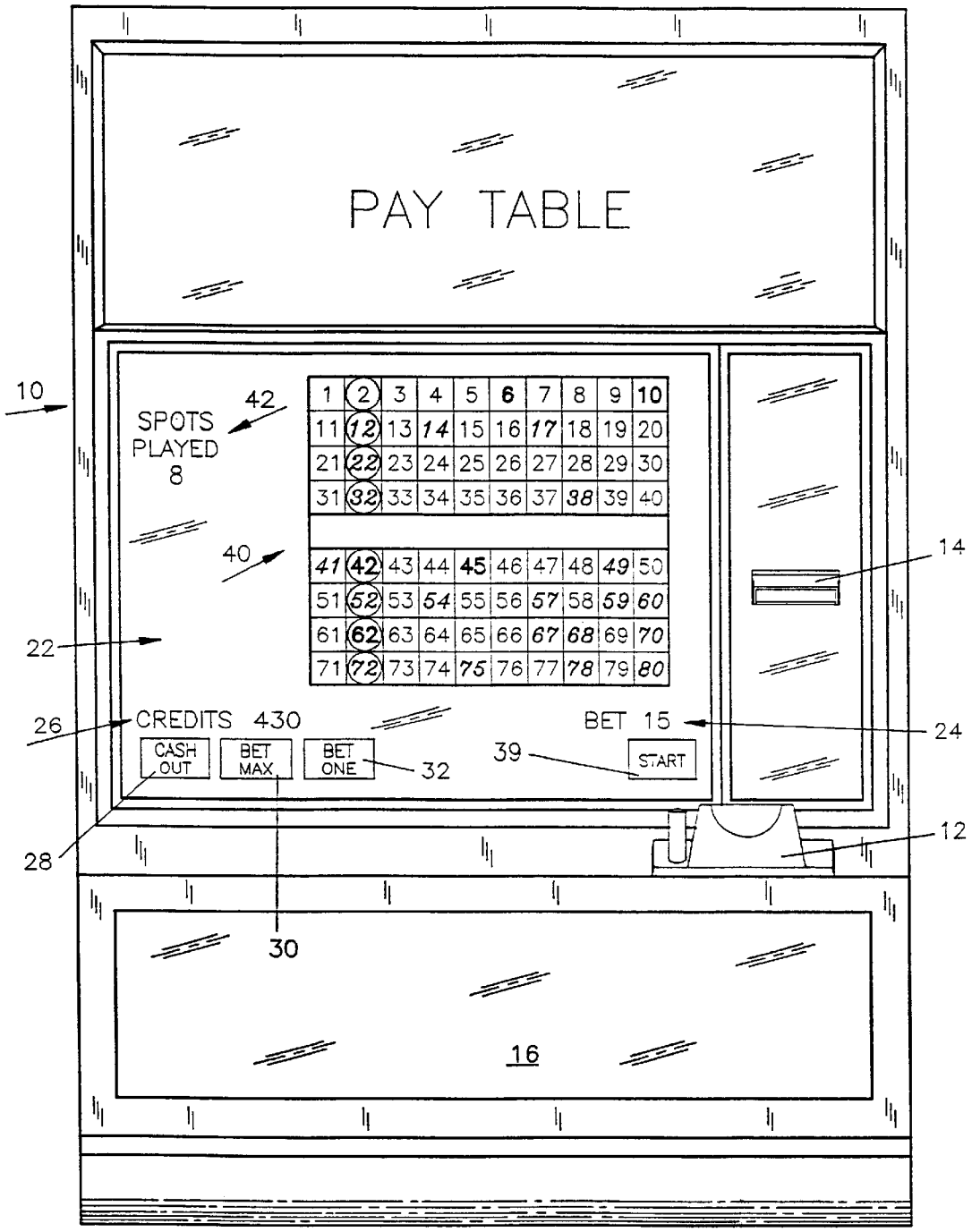
FIG. 3 shows the keno ticket after the additional draw of keno numbers based on the number of "Hits" achieved by the player.

In this version of the present invention, the quantity of additional keno numbers to be drawn is based on the number of "Hits" achieved in the initial base game draw of twenty numbers. In the example shown in FIG. 2, because there were five "Hits" in the initial base game draw of keno numbers, an additional five keno numbers are randomly selected. FIG. 3 shows the additional five keno numbers that were drawn are 6, 10, 42, 45 and 62.

Based on these additional five keno numbers that were drawn, the player now has seven "Hits" because the player "Hit" the 42 and 62 during the extra ball portion of the game in addition to the five "Hits" that the player achieved during the base game. As shown in the pay table of Table 1, the player would be awarded an additional sixty-five credits for achieving seven out of eight "Hits" during the extra ball portion of the keno game.

Any suitable pay table can be used depending on the payout percentage which the gaming establishment wishes to offer to the player. Using a probability analysis, calculations can be done to determine the probability of any amount of numbered spots being "Hit" according to the size of the complete keno number pool and quantity of keno numbers selected or drawn from the keno number pool.

The following pay tables are based on a complete keno number pool having eighty numbers and based on an initial selection or draw of twenty numbers. The payouts for the additional "Hits" on the extra keno numbers that are drawn are then calculated based on an additional keno number being drawn for each numbered spot being hit by the player during the initial draw of twenty keno numbers.

Table 2 shows a representative pay table when the player wagers on two numbered spots. Each payout amount is shown for each credit wagered by the player. Other suitable pay tables can be utilized if the gaming establishment wishes to offer a higher or lower game return to the player.

TABLE 2

TWO SPOT PAY TABLE
OVERALL GAME RETURN 91.77%

| | | EXTRA HITS | |
|---|---|---|---|
| Base Hits | Base Pay | 0 | 1 |
| 0 | 0 | — | — |
| 1 | 0 | 0 | 12 |
| 2 | 14 | — | — |

Table 3 shows a representative pay table when the player wagers on three numbered spots. Each payout amount is shown for each credit wagered by the player. Other suitable pay tables can be utilized if the gaming establishment wishes to offer a higher or lower game return to the player.

TABLE 3

THREE SPOT PAY TABLE
OVERALL GAME RETURN 91.72%

| | | EXTRA HITS | |
|---|---|---|---|
| Base Hits | Base Pay | 0 | 1 |
| 0 | 0 | — | — |
| 1 | 0 | 0 | 3 |
| 2 | 3 | 0 | 9 |
| 3 | 30 | — | — |

Table 4 shows a representative pay table when the player wagers on four numbered spots. Each payout amount is shown for each credit wagered by the player. Other suitable pay tables can be utilized if the gaming establishment wishes to offer a higher or lower game return to the player.

TABLE 4

FOUR SPOT PAY TABLE
OVERALL GAME RETURN 91.89%

| | | EXTRA HITS | | |
|---|---|---|---|---|
| Base Hits | Base Pay | 0 | 1 | 2 |
| 0 | 0 | — | — | — |
| 1 | 0 | 0 | 1 | — |
| 2 | 2 | 0 | 3 | 48 |
| 3 | 3 | 0 | 30 | — |
| 4 | 75 | — | — | — |

Table 5 shows a representative pay table when the player wagers on five numbered spots. Each payout amount is shown for each credit wagered by the player. Other suitable pay tables can be utilized if the gaming establishment wishes to offer a higher or lower game return to the player.

TABLE 5

FIVE SPOT PAY TABLE
OVERALL GAME RETURN 91.91%

| | | EXTRA HITS | | |
|---|---|---|---|---|
| Base Hits | Base Pay | 0 | 1 | 2 |
| 0 | 0 | — | — | — |
| 1 | 0 | 0 | 1 | — |
| 2 | 0 | 0 | 1 | 4 |
| 3 | 2 | 0 | 4 | 53 |
| 4 | 6 | 0 | 84 | — |
| 5 | 800 | — | — | — |

Table 6 shows a representative pay table when the player wagers on six numbered spots. Each payout amount is shown for each credit wagered by the player. Other suitable pay tables can be utilized if the gaming establishment wishes to offer a higher or lower game return to the player.

TABLE 6

SIX SPOT PAY TABLE
OVERALL GAME RETURN 91.72%

| | | EXTRA HITS | | | |
|---|---|---|---|---|---|
| Base Hits | Base Pay | 0 | 1 | 2 | 3 |
| 0 | 0 | — | — | — | — |
| 1 | 0 | 0 | 1 | — | — |
| 2 | 0 | 0 | 1 | 2 | — |
| 3 | 2 | 0 | 1 | 14 | 1998 |
| 4 | 4 | 0 | 16 | 297 | — |
| 5 | 70 | 0 | 230 | — | — |
| 6 | 800 | — | — | — | — |

Table 7 shows a representative pay table when the player wagers on seven numbered spots. Each payout amount is shown for each credit wagered by the player. Other suitable pay tables can be utilized if the gaming establishment wishes to offer a higher or lower game return to the player.

TABLE 7

SEVEN SPOT PAY TABLE
OVERALL GAME RETURN 91.87%

| | | EXTRA HITS | | | |
|---|---|---|---|---|---|
| Base Hits | Base Pay | 0 | 1 | 2 | 3 |
| 0 | 0 | — | — | — | — |
| 1 | 0 | 0 | 1 | — | — |
| 2 | 0 | 0 | 1 | 4 | — |
| 3 | 0 | 0 | 1 | 6 | 199 |
| 4 | 0 | 0 | 8 | 30 | 998 |
| 5 | 4 | 0 | 15 | 625 | — |
| 6 | 10 | 0 | 100 | — | — |
| 7 | 100 | — | — | — | — |

Table 8 shows a representative pay table when the player wagers on nine numbered spots. Each payout amount is shown for each credit wagered by the player. Other suitable pay tables can be utilized if the gaming establishment wishes to offer a higher or lower game return to the player.

TABLE 8

NINE SPOT PAY TABLE
OVERALL GAME RETURN 91.85%

| | | EXTRA HITS | | | | |
|---|---|---|---|---|---|---|
| Base Hits | Base Pay | 0 | 1 | 2 | 3 | 4 |
| 0 | 0 | — | — | — | — | — |
| 1 | 0 | 0 | 1 | — | — | — |
| 2 | 0 | 0 | 1 | 1 | — | — |
| 3 | 0 | 0 | 1 | 1 | 10 | — |
| 4 | 1 | 0 | 1 | 1 | 50 | 1999 |
| 5 | 4 | 0 | 1 | 40 | 1000 | 2996 |
| 6 | 12 | 0 | 12 | 138 | 1588 | — |
| 7 | 300 | 0 | 90 | 899 | — | — |
| 8 | 2000 | 0 | 199 | — | — | — |
| 9 | 7500 | — | — | — | — | — |

Table 9 shows a representative pay table when the player wagers on ten numbered spots. Each payout amount is shown for each credit wagered by the player. Other suitable pay tables can be utilized if the gaming establishment wishes to offer a higher or lower game return to the player.

TABLE 9

OVERALL GAME RETURN 91.79%

| | | EXTRA HITS | | | | | |
|---|---|---|---|---|---|---|---|
| Base Hits | Base Pay | 0 | 1 | 2 | 3 | 4 | 5 |
| 0 | 0 | — | — | — | — | — | — |
| 1 | 0 | 0 | 1 | — | — | — | — |
| 2 | 0 | 0 | 1 | 1 | — | — | — |
| 3 | 0 | 0 | 1 | 1 | 98 | — | — |
| 4 | 0 | 0 | 1 | 1 | 8 | 1000 | — |
| 5 | 4 | 0 | 1 | 1 | 28 | 2000 | 9995 |
| 6 | 10 | 0 | 1 | 1 | 298 | 3988 | — |
| 7 | 100 | 0 | 1 | 1 | 1098 | — | — |
| 8 | 800 | 0 | 1 | 399 | — | — | — |
| 9 | 2000 | 0 | 200 | — | — | — | — |
| 10 | 10000 | — | — | — | — | — | — |

A variation of the present invention involves the quantity of additional keno numbers to be drawn being cumulative from the "Hits" achieved over both the initial draw of keno numbers and during any additional draws. In other words, if the player achieves more "Hits" during the extra draw portion of the game, the player continues to receive additional "Hits" until the player has completed the extra draw portion of the game without achieving more "Hits". An award is made to the player for the total number of "Hits" achieved during the game and based on the amount wagered by the player.

For example, with reference to the example described above, the player achieved five "hits" during the base game and that entitled the player the player to five extra draws after the base game draws had been completed. During these five extra draws, the player achieved two more "Hits". This would then entitled the player to at least two more draws from the keno number pool. These extra draws would cumulatively continue until the player achieved no further "Hits" or until the player had achieved matches on all of the numbered spots that the player had originally marked.

Again, with regard to the example above, the player had matched seven out of eight numbered spots after the first five extra draws had occurred. Thus, if the player had one more "Hit" during either of the two additional cumulative extra draws, the player would have completed his Eight Spot and the game would conclude.

In this cumulative version method of play, different pay tables would have to be created based on the probabilities of achieving the various number of matches during the play of the game.

Another variation of the present invention involves rewarding the player for misses during the extra ball round of the game. Similar to the method described above, the player makes a wager and then selects a quantity of numbered spots, for example between two and ten numbered spots, to be played during the game. The computer controls then randomly select a first group comprising a preselected amount of keno numbers from the keno number pool. After this first group of numbers, for example, twenty numbers, have been drawn, the computer controls determine the quantity of hits achieved by the player between the first group of keno numbers and the numbered spots selected by the player. The player receives an award based on the number of "Hits" achieved and the amount wagered by the player during the base game.

The computer controls then randomly select a second group of keno numbers from the keno number pool, the amount of the second group of numbers being determined by the quantity of hits achieved by the player in the first portion of the game. The computer controls then determine the quantity of "Misses" achieved by the player between the second group of keno numbers and the numbered spots selected by the player.

It is, of course, possible to mathematically calculate the probability of the player achieving "Misses" during this second portion of the game. Using the mathematical probabilities, a pay table can be provided and an award can be made to the player based on the number of "Misses" achieved by the player and the amount of the wager during this second portion of the game.

The method of the present invention has been described in the context of the conventional keno format which uses a complete pool of eighty numbers, from which twenty numbers are drawn each game. However, the method of the present invention can also be applied to a keno-type game in which more or less than twenty numbers are drawn during the base game. Furthermore, the present invention can also be applied to a keno-type game in which the size of the complete pool can be more or less than eighty numbers and in which the amount of numbers drawn can vary. If the size of the complete pool is changed or the amount of numbers drawn is changed, then the payouts will also be changed to reflect the varying mathematical odds which are based on the size of the complete pool and the amount of numbers drawn during both the base game and the extra ball portion of the game.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a game of chance in which a number pool of eighty keno numbers is used comprising:

a) a player selecting between two and ten numbered spots to be played during the game;

b) randomly selecting a first group of twenty keno numbers from the keno number pool;

c) determining a first quantity of hits achieved by the player between the first group of keno numbers and the numbered spots selected by the player;

d) randomly selecting a second group of keno numbers from the keno number pool, the amount of the second group of numbers being equal to the first quantity of hits achieved by the player; and e) determining a second quantity of hits achieved by the player between the second group of keno numbers and the numbered spots selected by the player.

2. The method of claim 1 in which the player makes a wager to participate in the game and the player receives an award based on the amount of the wager and the quantity of hits achieved by the player.

3. The method of claim 1 in which the player makes a wager to participate in the game, the player receives a first award based on the amount of the wager and the first quantity of hits achieved by the player and the player receives a second award based on the amount of the wager and the second quantity of hits achieved by the player.

4. The method of claim 3 in which the amount of the first award and the amount of the second award are based on a pay table.

5. The method of claim 4 in which the player selects two numbered spots and the pay table is:

TWO SPOT PAY TABLE

| | | EXTRA HITS | |
|---|---|---|---|
| Base Hits | Base Pay | 0 | 1 |
| 0 | 0 | — | — |
| 1 | 0 | 0 | 12 |
| 2 | 14 | — | — |

6. The method of claim 4 in which the player selects three numbered spots and the pay table is:

THREE SPOT PAY TABLE

| | | EXTRA HITS | |
|---|---|---|---|
| Base Hits | Base Pay | 0 | 1 |
| 0 | 0 | — | — |
| 1 | 0 | 0 | 3 |
| 2 | 3 | 0 | 9 |
| 3 | 30 | — | — |

7. The method of claim 4 in which the player selects four numbered spots and the pay table is:

FOUR SPOT PAY TABLE

| | | EXTRA HITS | | |
|---|---|---|---|---|
| Base Hits | Base Pay | 0 | 1 | 2 |
| 0 | 0 | — | — | — |
| 1 | 0 | 0 | 1 | — |
| 2 | 2 | 0 | 3 | 48 |
| 3 | 3 | 0 | 30 | — |
| 4 | 75 | — | — | — |

8. The method of claim 4 in which the player selects five numbered spots and the pay table is:

FIVE SPOT PAY TABLE

| | | EXTRA HITS | | |
|---|---|---|---|---|
| Base Hits | Base Pay | 0 | 1 | 2 |
| 0 | 0 | — | — | — |
| 1 | 0 | 0 | 1 | — |
| 2 | 0 | 0 | 1 | 4 |
| 3 | 2 | 0 | 4 | 53 |
| 4 | 6 | 0 | 84 | — |
| 5 | 800 | — | — | — |

9. The method of claim 4 in which the player selects six numbered spots and the pay table is:

SIX SPOT PAY TABLE

| | | EXTRA HITS | | | |
|---|---|---|---|---|---|
| Base Hits | Base Pay | 0 | 1 | 2 | 3 |
| 0 | 0 | — | — | — | — |
| 1 | 0 | 0 | 1 | — | — |
| 2 | 0 | 0 | 1 | 2 | — |
| 3 | 2 | 0 | 1 | 14 | 1998 |
| 4 | 4 | 0 | 16 | 297 | — |
| 5 | 70 | 0 | 230 | — | — |
| 6 | 800 | — | — | — | — |

10. The method of claim 4 in which the player selects seven numbered spots and the pay table is:

SEVEN SPOT PAY TABLE

| | | EXTRA HITS | | | |
|---|---|---|---|---|---|
| Base Hits | Base Pay | 0 | 1 | 2 | 3 |
| 0 | 0 | — | — | — | — |
| 1 | 0 | 0 | 1 | — | — |
| 2 | 0 | 0 | 1 | 4 | — |
| 3 | 0 | 0 | 1 | 6 | 199 |
| 4 | 0 | 0 | 8 | 30 | 998 |
| 5 | 4 | 0 | 15 | 625 | — |
| 6 | 10 | 0 | 100 | — | — |
| 7 | 100 | — | — | — | — |

11. The method of claim 4 in which the player selects eight numbered spots and the pay table is:

EIGHT SPOT PAY TABLE

| | | EXTRA HITS | | | | |
|---|---|---|---|---|---|---|
| Base Hits | Base Pay | 0 | 1 | 2 | 3 | 4 |
| 0 | 0 | — | — | — | — | — |
| 1 | 0 | 0 | 1 | — | — | — |
| 2 | 0 | 0 | 1 | 2 | — | — |
| 3 | 0 | 0 | 1 | 4 | 200 | — |
| 4 | 1 | 0 | 2 | 8 | 599 | 3999 |
| 5 | 5 | 0 | 5 | 65 | 3195 | — |
| 6 | 70 | 0 | 30 | 3130 | — | — |
| 7 | 750 | 0 | 2250 | — | — | |
| 8 | 10000 | 0 | — | — | — | — |

12. The method of claim 4 in which the player selects nine numbered spots and the pay table is:

NINE SPOT PAY TABLE

| | | EXTRA HITS | | | | |
|---|---|---|---|---|---|---|
| Base Hits | Base Pay | 0 | 1 | 2 | 3 | 4 |
| 0 | 0 | — | — | — | — | — |
| 1 | 0 | 0 | 1 | — | — | — |
| 2 | 0 | 0 | 1 | 1 | — | — |
| 3 | 0 | 0 | 1 | 1 | 10 | — |
| 4 | 1 | 0 | 1 | 1 | 50 | 1999 |
| 5 | 4 | 0 | 1 | 40 | 1000 | 2996 |
| 6 | 12 | 0 | 12 | 138 | 1588 | — |
| 7 | 300 | 0 | 90 | 899 | — | — |
| 8 | 2000 | 0 | 199 | — | — | — |
| 9 | 7500 | — | — | — | — | — |

13. The method of claim 4 in which the player selects ten numbered spots and the pay table is:

TEN SPOT PAY TABLE

| | | EXTRA HITS | | | | | |
|---|---|---|---|---|---|---|---|
| Base Hits | Base Pay | 0 | 1 | 2 | 3 | 4 | 5 |
| 0 | 0 | — | — | — | — | — | — |
| 1 | 0 | 0 | 1 | — | — | — | — |
| 2 | 0 | 0 | 1 | 1 | — | — | — |
| 3 | 0 | 0 | 1 | 1 | 98 | — | — |
| 4 | 0 | 0 | 1 | 1 | 8 | 1000 | — |
| 5 | 4 | 0 | 1 | 1 | 28 | 2000 | 9995 |
| 6 | 10 | 0 | 1 | 1 | 298 | 3988 | — |
| 7 | 100 | 0 | 1 | 1 | 1098 | — | — |
| 8 | 800 | 0 | 1 | 399 | — | — | — |
| 9 | 2000 | 0 | 200 | — | — | — | — |
| 10 | 10000 | — | — | — | — | — | — |

14. A method of playing a game of chance in which a number pool of a predetermined quantity of keno numbers is used comprising:

a) a player selecting a quantity of numbered spots to be played during the game;

b) randomly selecting a first group comprising a preselected amount of keno numbers from the keno number pool;

c) determining a first quantity of hits achieved by the player between the first group of keno numbers and the numbered spots selected by the player;

d) randomly selecting a second group of keno numbers from the keno number pool, the amount of the second group of numbers being equal to the first quantity of hits achieved by the player; and e) determining a second quantity of hits achieved by the player between the second group of keno numbers and the numbered spots selected by the player.

15. The method of claim 14 in which the player makes a wager to participate in the game and the player receives an award based on the amount of the wager and the quantity of hits achieved by the player.

16. The method of claim 14 in which the player makes a wager to participate in the game, the player receives a first award based on the amount of the wager and the first quantity of hits achieved by the player and the player receives a second award based on the amount of the wager and the second quantity of hits achieved by the player.

17. The method of claim 16 in which the amount of the first award and the amount of the second award are based on a pay table.

18. A method of playing a game of chance in which a number pool of eighty keno numbers is used comprising:

a) a player selecting between two and ten numbered spots to be played during the game;

b) randomly selecting a first group of twenty keno numbers from the keno number pool;

c) determining a quantity of hits achieved by the player between the first group of keno numbers and the numbered spots selected by the player;

d) randomly selecting a second group of keno numbers from the keno number pool, the amount of the second group of numbers being equal to the quantity of hits achieved by the player; and e) determining a quantity of misses achieved by the player between the second group of keno numbers and the numbered spots selected by the player.

19. The method of claim 18 in which the player makes a wager to participate in the game, the player receives a first award based on the amount of the wager and the quantity of hits achieved by the player and the player receives a second award based on the amount of the wager and the quantity of misses achieved by the player.

20. The method of claim 19 in which the amount of the first award and the amount of the second award are based on a pay table.

21. A method of playing a game of chance in which a number pool of a predetermined quantity of keno numbers is used comprising:

a) a player selecting a quantity of numbered spots to be played during the game;

b) randomly selecting a first group comprising a preselected amount of keno numbers from the keno number pool;

c) determining a quantity of hits achieved by the player between the first group of keno numbers and the numbered spots selected by the player;

d) randomly selecting a second group of keno numbers from the keno number pool, the amount of the second group of numbers being equal to the quantity of hits achieved by the player; and e) determining a quantity of misses achieved by the player between the second group of keno numbers and the numbered spots selected by the player.

22. The method of claim 21 in which the player makes a wager to participate in the game, the player receives a first award based on the amount of the wager and the quantity of hits achieved by the player and the player receives a second award based on the amount of the wager and the quantity of misses achieved by the player.

23. The method of claim 22 in which the amount of the first award and the amount of the second award are based on a pay table.

24. A method of playing a game of chance in which a number pool of a predetermined quantity of keno numbers is used comprising:

a) a player selecting a quantity of numbered spots to be played during the game;

b) randomly selecting a first group comprising a preselected amount of keno numbers from the keno number pool;

c) determining a first quantity of hits achieved by the player between the first group of keno numbers and the numbered spots selected by the player;

d) randomly selecting a second group of keno numbers from the keno number pool, the amount of the second group of numbers being equal to the first quantity of hits achieved by the player and any additional hits achieved by the player during this additional selection; and e) determining a second quantity of hits achieved by the player between the second group of keno numbers and the numbered spots selected by the player.

25. The method of claim 24 in which the player makes a wager to participate in the game, the player receives a first award based on the amount of the wager and the quantity of hits achieved by the player and the player receives a second award based on the amount of the wager and the quantity of misses achieved by the player.

26. The method of claim 25 in which the amount of the first award and the amount of the second award are based on a pay table.

27. A method of playing a game of chance in which a number pool of a predetermined quantity of keno numbers is used comprising:

a) a player selecting a quantity of numbered spots to be played during the game;

b) randomly selecting a first group comprising a preselected amount of keno numbers from the keno number pool;

c) determining a quantity of hits achieved by the player between the first group of keno numbers and the numbered spots selected by the player;

d) randomly selecting a second group of keno numbers from the keno number pool, the amount of the second group of numbers being equal to the first quantity of hits achieved by the player and any additional hits achieved by the player during this additional selection; and e) determining a quantity of misses achieved by the player between the second group of keno numbers and the numbered spots selected by the player.

28. The method of claim 27 in which the player makes a wager to participate in the game, the player receives a first award based on the amount of the wager and the quantity of hits achieved by the player and the player receives a second award based on the amount of the wager and the quantity of misses achieved by the player.

29. The method of 28 in which the amount of the first award and the amount of the second award are based on a pay table.

* * * * *